US006176298B1

(12) United States Patent
Watters

(10) Patent No.: US 6,176,298 B1
(45) Date of Patent: Jan. 23, 2001

(54) CONTINUOUS CASTING MOULD

(75) Inventor: John Huddart Watters, Worksop (GB)

(73) Assignee: Davy Distington Limited (GB)

( * ) Notice: Under 35 U.S.C. 154(b), the term of this patent shall be extended for 0 days.

(21) Appl. No.: 09/284,428

(22) PCT Filed: Oct. 10, 1997

(86) PCT No.: PCT/GB97/02808

§ 371 Date: Jun. 10, 1999

§ 102(e) Date: Jun. 10, 1999

(87) PCT Pub. No.: WO98/16336

PCT Pub. Date: Apr. 23, 1998

(30) Foreign Application Priority Data

Oct. 15, 1996 (GB) ..... 9621427

(51) Int. Cl.[7] ..... B22D 11/00
(52) U.S. Cl. ..... 164/418; 164/138
(58) Field of Search ..... 164/418, 138

(56) References Cited

U.S. PATENT DOCUMENTS 5,499,672 3/1996 Nakashima et al. .

FOREIGN PATENT DOCUMENTS 1217314 2/1987 (CA) .
833394 3/1952 (DE) .
846900 8/1952 (DE) .
3427756 3/1985 (DE) .
3336373 4/1985 (DE) .
0228335 7/1987 (EP) .
0383934 8/1990 (EP) .
0448773 10/1991 (EP) .
812802 5/1937 (FR) .
2073634 10/1981 (GB) .
2174320 11/1986 (GB) .
56-080356 7/1981 (JP) .
59-073153 4/1984 (JP) .
63-180347 7/1988 (JP) .
02220736 9/1990 (JP) .
04123846 4/1992 (JP) .

OTHER PUBLICATIONS

Search Report relating to corresponding PCT application No. PCT/GB 97/02808.

Search Report relating to corresponding British application No. GB 9721452.2.

*Primary Examiner*—Kuang Y. Lin
(74) *Attorney, Agent, or Firm*—Trexler, Bushnell, Giangiorgi, Blackstone & Marr, Ltd.

(57) ABSTRACT

A continuous casting mould wall (1, 2) has a non-metallic coating (5) thereon the thickness of which is different at first and third regions (6, 9) closer to the inlet and outlet ends respectively of the mould passage (3), from that at a second region (8), whereby the meniscus of molten metal can be in the first region (6) and solidification can commence in contact with the first or second regions (6, 8), whilst the solidifying casting passes through the third region (9) with reduced wear on the mould.

11 Claims, 1 Drawing Sheet

CONTINUOUS CASTING MOULD

BACKGROUND OF THE INVENTION

This invention relates to continuous casting moulds and to the use of such moulds.

Moulds which are employed in the continuous casting of steel have a mould passage extending from the inlet end to the outlet end. The shape of the mould passage is arranged to produce at the outlet end a casting of the required dimensions, and a slight taper may extend along the length of the mould passage, in the direction of casting, to counteract shrinkage of the casting during soldification.

The wall of the mould passage may be defined by one metal body of tubular form or in the case of square and rectangular sections the wall of the mould passage may be defined by four copper cooling plates which are clamped together.

In use, molten metal is introduced into the inlet end of the mould passage at such a rate as to form a liquid metal meniscus in the mould passage, and cooling is arranged so that a solid metal shell containing a liquid or "mushy" core is withdrawn from the outlet end of the mould passage.

If care is not taken, the casting can contain defects such as surface cracks and non-metallic particles and these can cause the casting to be rejected. Furthermore, bulging is a frequent defect caused by mould wear and this leads to internal cracking of the casting and rupture of the shell can occur.

It is known from EP-A-448773 to line a continuous casting mould with pieces of tiles of ceramics having resistance to wear, heat and thermal shock, heat conductivity and lubricating property, and of progressively reducing thickness to prevent the formation of air gaps between the surface of the lining and the solidifying shell, and cool the steel being cast according to a desired pattern, and/or to start solidification of the molten metal below the molten metal surface level.

Variations on this are to be found in JP-A-04123846 and JP-A-02220736 (and see also FR-A-812802).

SUMMARY OF THE INVENTION

In contrast and according to the present invention, the lining comprises a continuous coating the maximum thickness of which is 5 mm, and the thickness of the coating is different at first and third regions from that at a second region of the mould passage, said first and third regions being closer to the inlet end and the outlet end respectively than is the second region, and the thickness of the third region being greater than the thickness of the second region.

It is an object of the present invention to provide a continuous casting mould in which these difficulties are at least partially overcome.

According to the present invention a continuous casting mould has a mould passage extending from the inlet end to the outlet end of the mould and which is defined by at least one metal body, and wherein the wall of the mould passage has a non-metallic coating thereon and the thickness of the coating is different at first and third regions from that at a second region of the mould passage, said first and third regions being closer to the inlet end and the outlet end respectively than is the second region. In use the meniscus of molten metal is intended to be present at the first region and solidification of the molten metal may commence in contact with the first or second regions of the mould passage.

By providing the non-metallic coating in varying thickness the heat transfer in the mould can be designed such that the meniscus can be further separated from the region where solidification commences.

The non-metallic coating is conveniently a metal carbide ceramic composite, which in addition to reducing the heat transfer in the mould also reduces wear of the mould, and this means that the accurate mould dimensions are maintained for longer periods than has been the case hitherto.

The thickness of the coating can be greatest in the first region where it is intended that the meniscus will be present, and at this region it may be between 0.3 mm and 5 mm on the wall of the mould passage.

Electric heating elements may be positioned in the wall of the mould passage at the region where the meniscus is to be present, and the coating is applied to the wall to overlie the heating elements.

At the second region, where solidification may commence, the thickness of the coating, which is less than at the first region, may be of the order of 0.03 mm to 0.75 mm.

At the third region, i.e. near the mould outlet, the thickness of the coating, which may be greater than at the second region, can be say 0.25 mm to 1 mm in order to reduce wear.

BRIEF DESCRIPTION OF THE DRAWINGS

An embodiment of the invention will now be described, by way of example only, with reference to the accompanying diagrammatic drawings in which.

DETAILED DESCRIPTION OF THE DRAWINGS

Figure 1:
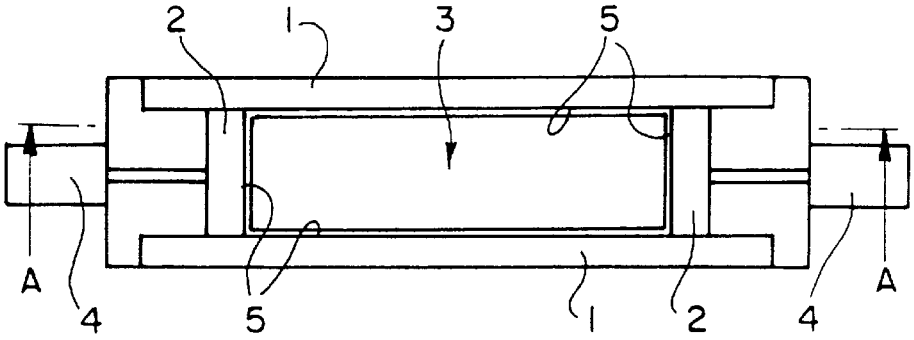
FIG. 1 is a small scale plan view of a continuous casting mould.
Figure 2:
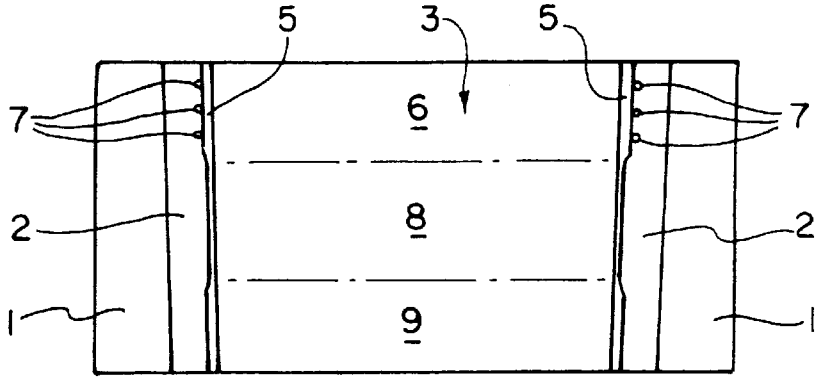
FIG. 2 is a vertical section on the line A—A of FIG. 1.
Figure 3:
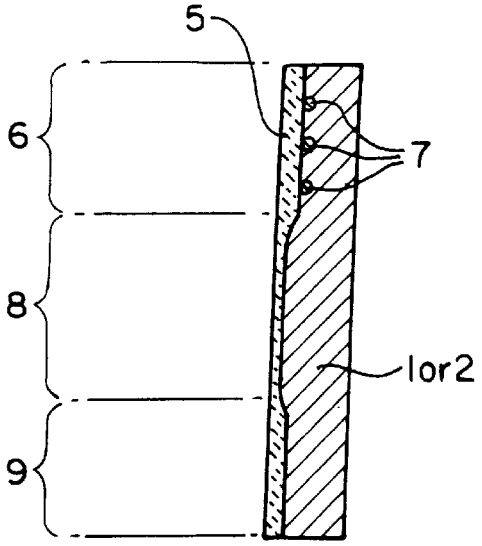
FIG. 3 is an enlarged vertical section through a mould plate.

A mould for the continuous casting of steel strands comprises four cooled copper plates 1, 2 which together define the wall of a mould passage 3 which extends from the inlet end to the outlet end of the mould. One pair of the plates 1 are of generally rectangular form and the other pair of plates 2 are located between the plates 1 and are at right angles to them. The mould passage 3 is of rectangular cross-section and the plates 2 are movable towards and away from each other by drive means 4 so that the dimension of the mould passage between these plates can be adjusted. The mould is of sufficient length to ensure that a shell (not shown) of adequate thickness has formed at the outlet end to allow the casting to be removed at a predetermined withdrawal rate.

The plates 1 and 2 provide a mould passage which is tapered slightly in the direction of casting to allow for shrinkage of the casting. The plates are cooled by means of coolant in ducts (not shown) behind the mould plates.

The surfaces of the plates 1 and 2 which define the wall of the mould passage are provided with a coating 5 of a non-metallic material which affects the heat transfer between the copper plates and the metal in the mould during casting. Such a material is a metal carbide ceramic composite. The coating extends from the upper inlet end of the mould passage down the length of the mould passage to the outlet end.

The thickness of the coating at a first region 6 where the meniscus is to be present may be arranged to be such that the coating reduces the heat transfer to such an extent that solidification of the molten metal will not commence at this region. Furthermore, electric heating elements 7 are embedded in the wall of the plates 1, 2 to add heat to the region to ensure that solidification does not take place. The thickness of the coating at this region may be of the order of 0.03 mm to 5 mm.

Alternatively, at the region 6 the thickness of the coating can be arranged so that the heat transfer is reduced and the cooling applied to the plates is transferred to the molten metal which starts to solidify at this region and forms the shell which contains the core of the casting. In this case the thickness of the coating may again be of the order of 0.03 mm to 0.5 mm. The presence of the coating of reduced thickness will cause a slow shell growth to occur which reduces a tendency for the shell to crack.

At a second intermediate region S the thickness of the coating is reduced so that cooling of the plates is transferred to the solidified shell. Furthermore, the coating due to its properties will prevent the shell from sticking when slag lubrication is not present, and the coating reduces the wear which occurs at the outlet end of the mould passage, thereby increasing mould life.

At a third region 9, at the outlet end of the mould passage, the thickness of the coating is increased so that wear at the outlet of the mould is reduced and mould dimensions are retained for a greater length of time. The thickness of the coating may be of the order of 0.25 mm to 1 mm.

Advantages of the invention are:

1) The liquid meniscus can be substantially separated from the formation of the solid shell.
2) The rate of shell formation can be optimised by choice of coating thickness.
3) Properties of the surface coating can prevent the shell sticking when other lubrication is not present.
4) Mould wear can be reduced by the presence of the coating thus giving increased mould life.

What is claimed is:

1. A continuous casting mould (1, 2) having a mould passage (3) extending from the inlet end to the outlet end of the mould and which is defined by at least one metal body, and wherein the wall of the mould passage has a non-metallic lining (5) characterized in that the lining (5) comprises a continuous coating the maximum thickness of which is 5 mm, and the thickness of the coating is different at first and third regions (6, 9) from that at a second region (8) of the mould passage, said first and third regions (6, 9) being closer to the inlet end and the outlet end respectively than is the second region (9), and the thickness of the third region (9) being greater than the thickness of the second region (8).

2. A continuous casting mould as in claim 1, characterized in that the continuous non-metallic coating (5) is a metal carbide ceramic composite.

3. A continuous casting mould as in claim 1 or claim 2, characterized in that the thickness of the coating (5) is greatest in the first region (6) where it is intended that the meniscus will be present and where solidification may commence.

4. A continuous casting mould as in claim 3, characterized in that the thickness of the coating in the first region (6) is between 0.03 mm and 5 mm.

5. A continuous casting mould as in claim 3, characterized in that electric heating elements (7) are positioned in the wall (1, 2) of the mould passage (3) at the region where the meniscus is to be present, and the coating (5) is applied to the wall to overlie the heating elements.

6. A continuous casting mould as in claim 1 or claim 2, characterized in that at the second region (8), where solidification may commence, the thickness of the coating (5), is of the order of 0.03 mm to 0.75 mm.

7. A continuous casting mould as in claim 1 or claim 2, characterized in that at the third region (9), the thickness of the coating is of the order of 0.25 mm to 1 mm.

8. A continuous casting mould as in claim 1 or claim 2, characterized in that the mould passage (3) is defined by one metal body of tubular form.

9. A continuous casting mould as in claim 1 or claim 2, characterized in that the mould passage (3) is formed by four cooled copper plates (1, 2) clamped together.

10. A continuous casting mould as in claim 8, characterized in that the mould passage (3) is tapered slightly in the direction of casting to allow for shrinkage of the casting.

11. A continuous casting mould as in claim 9, characterized in that the mould passage (3) is tapered slightly in the direction of casting to allow for shrinkage of the casting.

* * * * *